US007749050B2

(12) United States Patent
Sung et al.

(10) Patent No.: US 7,749,050 B2
(45) Date of Patent: Jul. 6, 2010

(54) PAD CONDITIONER DRESSER

(75) Inventors: Chien-Min Sung, 4, Lane 32, Chung-Cheng Road, Tansui, Taipei County 251 (TW); Yang-Liang Pai, Taipei (TW)

(73) Assignee: Chien-Min Sung, Tansui (TW)

( * ) Notice: Subject to any disclaimer, the term of this patent is extended or adjusted under 35 U.S.C. 154(b) by 0 days.

(21) Appl. No.: 12/346,264

(22) Filed: Dec. 30, 2008

(65) Prior Publication Data

US 2009/0170407 A1 Jul. 2, 2009

Related U.S. Application Data

(63) Continuation-in-part of application No. 11/349,034, filed on Feb. 6, 2006, now Pat. No. 7,473,162, and a continuation-in-part of application No. 11/606,365, filed on Nov. 27, 2006.

(51) Int. Cl.
*B24B 53/00* (2006.01)

(52) U.S. Cl. ..... 451/21; 451/56

(58) Field of Classification Search ..... 451/21, 451/443, 444, 72, 56, 5

See application file for complete search history.

(56) References Cited

U.S. PATENT DOCUMENTS

| | | | | |
|---|---|---|---|---|
| 5,834,377 | A | 11/1998 | Chen et al. | |
| 5,913,714 | A | 6/1999 | Volodarsky et al. | |
| 6,059,636 | A | 5/2000 | Inaba et al. | |
| 6,191,038 | B1 * | 2/2001 | Yoshida et al. | 438/691 |
| 6,220,936 | B1 | 4/2001 | Quek | |
| 6,402,588 | B1 | 6/2002 | Matsuo et al. | |
| 6,416,617 | B2 | 7/2002 | Yoshida et al. | |
| 6,517,414 | B1 | 2/2003 | Tobin et al. | |

(Continued)

OTHER PUBLICATIONS

Sung et al., Diamond Wear Pattern of CMP Pad Conditioner. VMIC 2004, 15 pages, Taiwan.

(Continued)

*Primary Examiner*—Robert Rose
(74) *Attorney, Agent, or Firm*—Thorpe North & Western LLP

(57) ABSTRACT

Methods for extending the service life of a CMP pad dresser having a substrate and a plurality of superabrasive particles disposed thereon which is used to dress a CMP pad are disclosed and described. The method may include dressing the chemical mechanical polishing pad with the dresser; determining superabrasive particle wear by measuring a mechanical property of the pad, dresser, or combination thereof; and responding to the mechanical property measurement by varying pressure and RPM between the pad and the dresser in relation to the superabrasive particle wear in order to extend dresser life. Additionally, a method may include dressing the chemical mechanical polishing pad with the dresser; vibrating, in a direction substantially parallel to a working surface of the pad, a member selected from the pad, the dresser, a wafer being polished by the pad, or any combination thereof, to minimize a mechanical stress on the pad, dresser, wafer, or combination thereof; and varying the pressure and RPM between the pad and the dresser, including gradually increasing the pressure and/or the RPM between the pad and the dresser in a non-linear manner over time as the dresser is used, such that the dresser life is extended, wherein the pressure and the RPM is increased when the chemical mechanical polishing pad surface exhibits wear.

19 Claims, 2 Drawing Sheets

U.S. PATENT DOCUMENTS

| | | | | |
|---|---|---|---|---|
| 6,561,875 | B1 | 5/2003 | Homma et al. | |
| 6,575,820 | B2 | 6/2003 | Lui et al. | |
| 6,616,513 | B1 | 9/2003 | Osterheld | |
| 6,733,363 | B2 | 5/2004 | Moore | |
| 6,976,907 | B2 * | 12/2005 | Golzarian et al. | 451/56 |
| 7,089,081 | B2 | 8/2006 | Palmgren | |
| 7,210,981 | B2 | 5/2007 | Yilmaz et | |
| 7,473,162 | B1 | 1/2009 | Sung et al. | |
| 2003/0166383 | A1 | 9/2003 | Kumura et al. | |

OTHER PUBLICATIONS

Ming-Yi Tsai et al., CMP Pad Dressing With Oriented Diamond. VMIC, 2004, 5 pages, Taiwan.

* cited by examiner

PAD CONDITIONER DRESSER

PRIORITY DATA

This is a continuation-in-part of U.S. patent application Ser. No. 11/349,034 filed on Feb. 6, 2006 now U.S. Pat. No. 7,473,162 and of U.S. patent application Ser. No. 11/606,365 filed on Nov. 27, 2006, which are hereby incorporated by reference in their entireties.

FIELD OF THE INVENTION

The present invention relates generally to methods for dressing or conditioning a chemical mechanical polishing (CMP) pad. Accordingly, the present invention involves the chemical and material science fields.

BACKGROUND OF THE INVENTION

Chemical mechanical polishing (CMP) is an effective planarization process utilized in the semiconductor industry for manufacturing wafers of ceramic, silicon, glass, quartz, and metals, including the processes of inter-level dielectric (ILD) and Damascene metallization. Such polishing processes generally entail applying the wafer against a rotating pad made from a durable organic substance such as polyurethane. A slurry containing a chemical capable of breaking down the wafer substance is introduced onto the pad. The slurry additionally contains abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles across the surface of the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, to keep the fibers as erect as possible, and to assure that there are an abundance of open pores available to receive new abrasive particles.

One problem with maintaining the top of the pad results from an accumulation of debris from the work piece and the abrasive slurry. This accumulation causes a "glazing" or hardening of the top of the pad, and causes the fibers to mat down, thus making the pad less able to hold new abrasive particles from the ongoing slurry flow. This situation significantly decreases the pad's overall polishing performance. Therefore, attempts have been made to revive the top of the pad by "combing" or "cutting" it with various devices. This process has come to be known as "dressing" or "conditioning" the CMP pad. Many types of devices and processes have been used for this purpose. One such device is a dresser disk with a plurality of superabrasive particles, such as diamond, attached to a surface or substrate.

New dresser disks have sharp superabrasive particles that cut dense, deep asperities into the CMP pad surface. The slurry is effectively held in these deep asperities, resulting in a high polishing rate of the wafer. Through continued use, however, the superabrasive particles in the dresser disk begin to wear, and their tips begin to gradually dull. The dull superabrasive particles do not penetrate into the CMP pad surface as deeply and the cutting grooves becomes wider as the superabrasive particle tips wear down. This wearing effect results in asperities that are wide, sparse, and shallow. CMP pads conditioned with such a dresser disk can no longer effectively hold the slurry, thereby decreasing the polishing rate of the wafer. Superabrasive particles on the dresser disk will continue to wear until they are pressing into the pad without cutting. Also, less effective cutting by the dresser disk causes debris to collect on the CMP pad surface, resulting in uneven polishing and increased wafer scratching.

In view of the foregoing, methods of using and constructing CMP pad dresser disks that achieve superior dressing results, with maximized efficiency and lifespan continue to be sought.

SUMMARY OF THE INVENTION

Accordingly, the present invention provides a method for extending the useful service life of a chemical mechanical polishing pad dresser used to dress a chemical mechanical polishing pad, the dresser having a substrate and a plurality of superabrasive particles disposed thereon. Such a method may include dressing the chemical mechanical polishing pad with the dresser; determining superabrasive particle wear by measuring a mechanical property of the pad, dresser, or combination thereof; and responding to the mechanical property measurement by varying pressure and RPM between the pad and the dresser in relation to the superabrasive particle wear in order to extend dresser life.

In another embodiment, the method may include dressing the chemical mechanical polishing pad with the dresser; vibrating, in a direction substantially parallel to a working surface of the pad, a member selected from the pad, the dresser, a wafer being polished by the pad, or any combination thereof, to minimize a mechanical stress on the pad, dresser, wafer, or combination thereof; and varying the pressure and RPM between the pad and the dresser, including gradually increasing the pressure and/or the RPM between the pad and the dresser in a non-linear manner over time as the dresser is used, such that the dresser life is extended, wherein the pressure and the RPM is increased when the chemical mechanical polishing pad surface exhibits wear.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Figure 1:
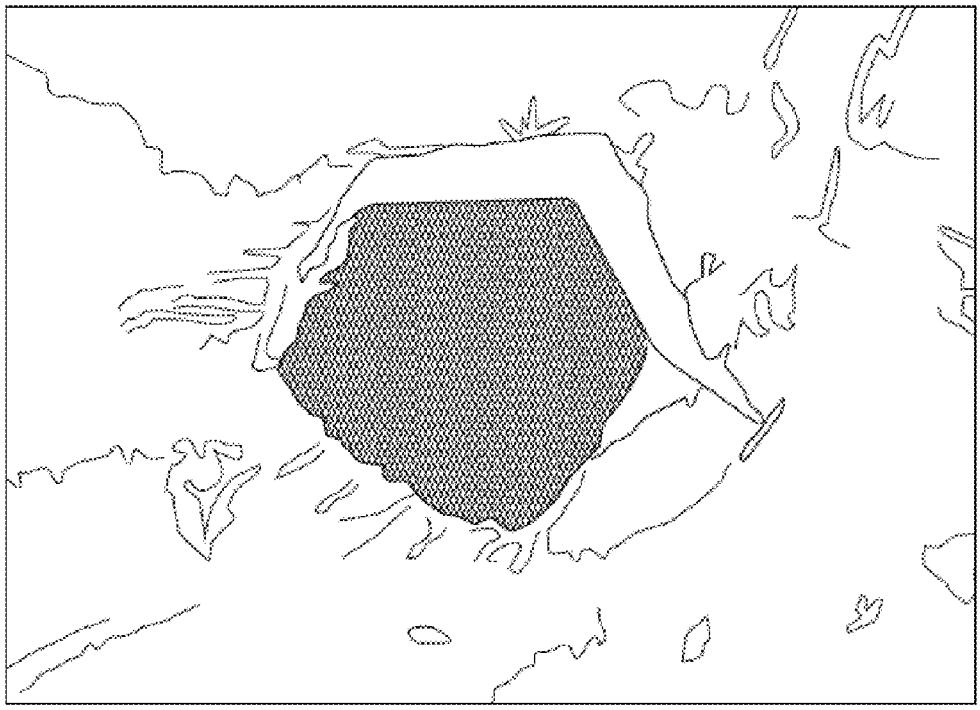
FIG. 1 is a photograph of superabrasive particle showing little wear.

Before the present methods are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and "the" include plural referents unless the context clearly dictates otherwise. Thus, for example, reference to an "abrasive particle" or a "pad" includes reference to one or more of such abrasive particles or pad.

Definitions

In describing and claiming the present invention, the following terminology will be used in accordance with the definitions set forth below.

As used herein, "superabrasive particle," "abrasive particle," "grit," or similar phrases mean any super hard crystalline, or polycrystalline substance, or mixture of substances, and include, but are not limited to, diamond, polycrystalline diamond (PCD), cubic boron nitride (CBN), and polycrystalline cubic boron nitride (PCBN). Further, the terms "superabrasive particle," "abrasive particle," "grit," "diamond," "polycrystalline diamond," "cubic boron nitride," and "polycrystalline cubic boron nitride," may be used interchangeably.

As used herein, "super hard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "substrate" means the base portion of a CMP dresser having a surface on which the abrasive particles may be affixed. The base portion may be any shape, thickness, or material, and includes but is not limited to metals, alloys, ceramics, and mixtures thereof.

As used herein, "working surface" means the surface of a CMP pad dresser that, during operation, faces toward, or comes in contact with a CMP pad.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "sharp portion" means any narrow apex to which a crystal may come, including but not limited to corners, ridges, edges, obelisks, and other protrusions.

As used herein, "pressure" refers to the applied force between a CMP pad dresser and a CMP pad. Thus reference to increasing or decreasing pressure refers to variations in the applied force between the dresser and the pad that causes an increase or decrease in pressure.

As used herein, "RPM" refers to the relative motion as measured in revolutions per minute between the CMP pad and the CMP dresser during a dressing operation. As such, it is contemplated herewith that one or both of the pad and dresser may by in motion. Thus reference to increasing or decreasing RPM refers to variations in the applied force between the dresser and the pad that causes an increase or decrease in RPM.

As used herein, "dressing operation" refers to a period when the dresser is pressing against and actively dressing the pad.

As used herein, "vibrate" means to oscillate an object in a substantially horizontal direction, back and forth or from side to side, in a rapid movement. Vibrations may be continuous, intermittent, continuously variable, in accordance with a vibrational program, etc. Accordingly, a CMP pad, CMP pad dresser, wafer, or superabrasive particles of a CMP pad dresser can be vibrated at a desired frequency to obtain an optimal polishing performance.

As used herein, "ultrasonic" means any energy wave that vibrates with frequencies higher than those audible to the human ear. For example such frequencies are higher frequencies than about 15,000 Hz, or in other words more than about 15,000 cycles per second.

As used herein, "substantially" when used in reference to a quantity or amount of a material, or a specific characteristic thereof, refers to an amount that is sufficient to provide an effect that the material or characteristic was intended to provide. The exact degree of deviation allowable may in some cases depend on the specific context.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc.

This same principle applies to ranges reciting only one numerical value. Furthermore, such an interpretation should apply regardless of the breadth of the range or the characteristics being described.

The Invention

Figure 2:
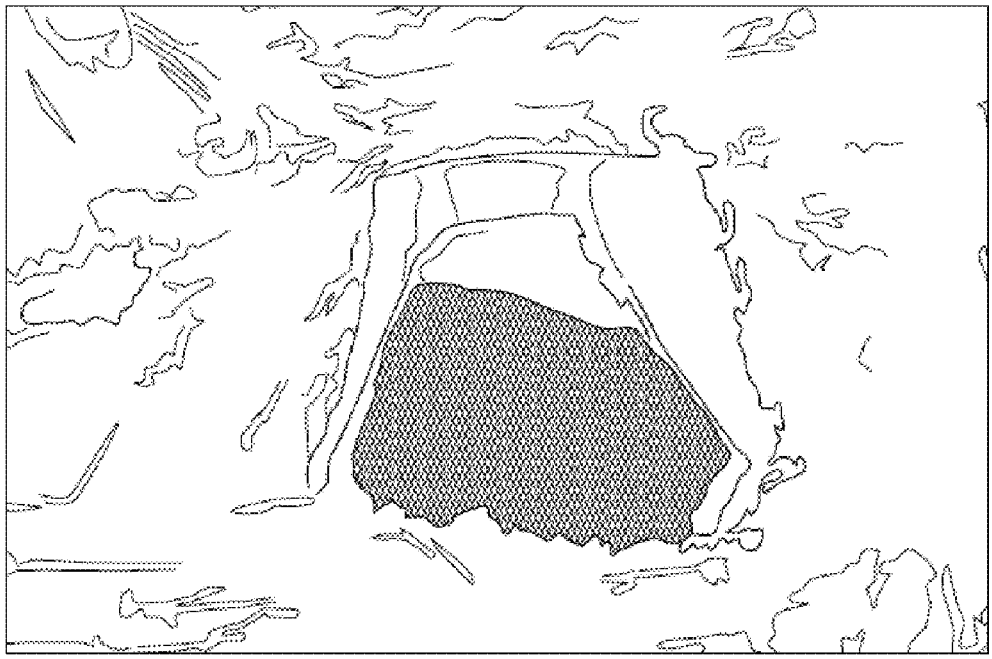
FIG. 2 is a photograph of a superabrasive particle showing some wear.
Figure 3:
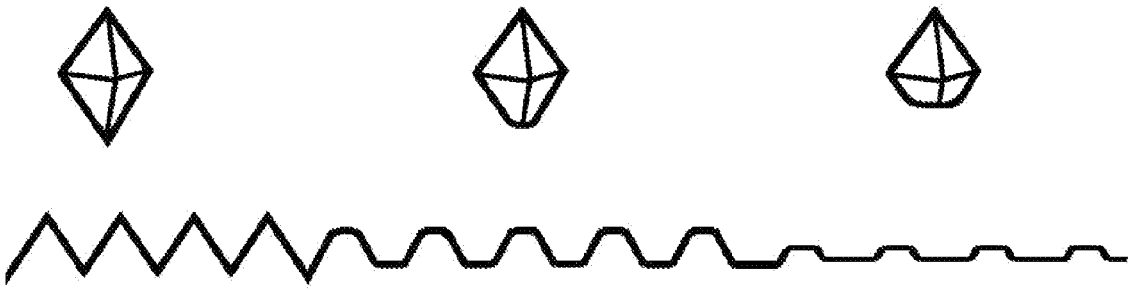
FIG. 3 is a illustrative diagram showing superabrasive particles and describing potential cutting patterns generated by the superabrasive particles according to an embodiment of the present invention.
Figure 4:
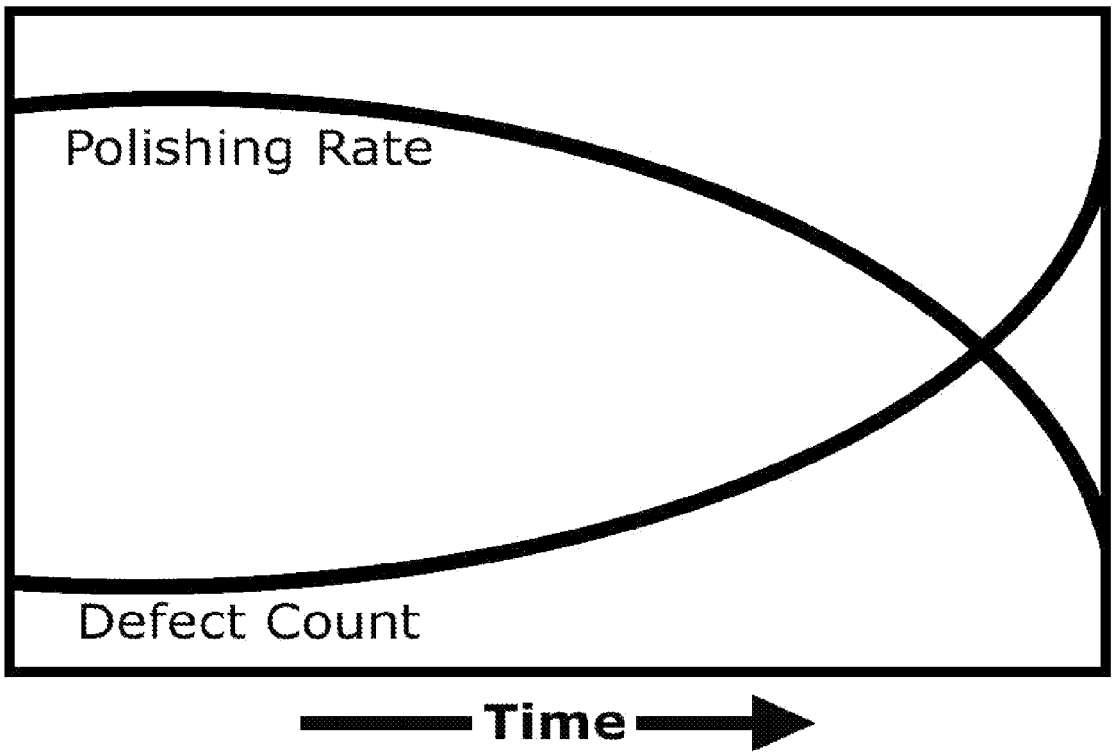
FIG. 4 is a graph depicting an example of polishing rate and defect count over time according to an embodiment of the present invention.

As previously discussed, CMP pad dressers are used to dress CMP pads in order to remove dirt and debris, and to restore asperities in the surface of the pad. Asperities are important to the function of the CMP pad, as they hold and channel slurry across the material being polished. Higher rates of polishing may be achieved when the CMP contains deep, dense asperities to hold the slurry. Sharp superabrasive particles such as diamond, as shown in FIG. 1, are able to cut such optimal asperities in the CMP pad that maximize retention of the slurry, and thus provide a high rate of polishing. As the dresser is used, the embedded superabrasive particles begin to wear over time, and their tips and edges become dull and rounded as shown in FIG. 2. Worn superabrasive particles cut less effectively into the CMP pad, resulting in a pad surface with asperities that are shallow, wider, and sparse. FIG. 3 is a diagrammatic representation that illustrates superabrasive particle wear and the subsequent effects on cutting patterns in the CMP pad. As superabrasive particles wear, cutting patterns of the dresser changes. Sharp superabrasive particles 10 cut deep asperities 12 in the surface of the CMP pad 14. As the superabrasive particles begin to wear 16, moderately deep asperities 18 are cut into the CMP pad surface 14. When superabrasive particles become significantly worn 20, very shallow asperities 22 are cut, if at all. The superabrasive particles eventually become so worn that they can no longer cut and/or clean, but merely rub against the pad surface. The surface of the pad becomes hard and covered with debris, increasing the rate of scratching and damage to the wafer or other work surface. As such, the polishing rate of the CMP pad will decline over time as the superabrasive particles wear. As shown in FIG. 4, as the service life of the CMP pad dresser increases (time), the polishing rate 30 decreases and the defect count 32 increases (FIG. 4).

The inventor has discovered that by varying the force applied to the CMP pad by the CMP pad dresser in relation to the level of wear of the superabrasive particles of the dresser, the service life of the dresser can be extended. For example, increasing the force between the CMP pad dresser and the CMP pad as the superabrasive particles wear leads to an increase in the service life of the dresser. By increasing the pressure and/or RPM, superabrasive particles press more deeply into the pad and thus cutting efficiency is increased. Additionally, such an increase in pressure and/or RPM will also allow a greater proportion of the superabrasive particles to come into contact with the pad surface. Superabrasive particles that do not protrude as far from the surface of the dresser can contact and dress the pad under increased pressure and/or RPM. Such an increase in pressure and/or RPM may be implemented before the superabrasive particles are completely worn, as significantly worn superabrasive particles tend to facilitate damage to the wafer. Accordingly, in one aspect a method for extending the service life of a CMP pad dresser having a substrate and a plurality of superabrasive particles disposed thereon when used to dress a CMP pad is provided. The method may further include dressing the chemical mechanical polishing pad with the dresser; determining superabrasive particle wear by measuring a mechanical property of the pad, dresser, or combination thereof; and responding to the mechanical property measurement by varying pressure and RPM between the pad and the dresser in relation to the superabrasive particle wear in order to extend dresser life.

Current practices tend to apply the dresser to the CMP pad with a fixed pressure, often about 10 lbs throughout the life of the dresser, as well as RPM. Similarly, current dressing machines can only apply a fixed pressure and require that the machine be stopped in order for the pressure to be reset. Conversely, aspects of the present invention contemplate increasing the pressure and/or RPM between the CMP pad and the dresser as a result of actual or anticipated wear of the associated superabrasive particles. By increasing these applied forces, the superabrasive particle tips can cut deeper into the CMP pad surface while the superabrasive particles are still in a condition to cut. Without wishing to be bound by theory, it is believed that increasing the pressure and/or RPM in relation to superabrasive particle wear may increase the service life of the tool because the increased pressure and/or RPM may offset such wear. It should be noted that an increase of the applied forces is most effective if accomplished prior to the superabrasive particles becoming too dull to penetrate the pad, regardless of the amount of pressure applied. The extent of the increase in pressure and/or RPM or applied force can readily be determined by one skilled in the art from examining the cutting pattern, examining the superabrasive particles, making estimations of superabrasive particle wear, etc. The amount of applied forces will also be dependent on the dresser size, dresser machine specifications, and the type of polishing being performed. Given such variations, a simple range of how much to vary the pressure and/or RPM is not practical. One of ordinary skill in the art can, however, readily determine the necessary variations in pressure and/or RPM for a particular polishing process once in possession of the present disclosure. In one specific aspect, however, the pressure and/or RPM between the CMP pad and the CMP pad dresser may be increased by from about 1% to about 100%. In another specific aspect, the pressure and/or RPM may be increased by from about 1% to about 50%. In yet another specific aspect, the pressure and/or RPM may be increased by from about 1% to about 20%. In a further specific aspect, the pressure and/or RPM may be increased by from about 1% to about 10%. In another further specific aspect, the pressure and/or RPM may be increased by less than about 5%. In yet a further aspect the pressure and/or RPM may be increased by greater than about 100%.

It should also be understood that varying the pressure and/or RPM may also include decreasing the pressure and/or RPM, particularly for those dressers with superabrasive particles exhibiting little or no wear. Sharp superabrasive particles often cut more deeply into the CMP pad than is required to hold the slurry. Such "overdressing" causes the superabrasive particles to wear more quickly. By decreasing the pressure and/or RPM between the pad and the dresser when the superabrasive particles are sharp, overall wear of the particles may be reduced and the service life of the dresser can be further extended.

The timing and extent of the increase in pressure and/or RPM between the CMP pad dresser and the CMP pad may be facilitated by making a determination of superabrasive particle wear. Various methods of determining superabrasive particle wear are contemplated, all of which are considered to be within the scope of the present invention. Such a determination may be an actual determination or an estimation based on calculated or assumed wear patterns. Accordingly, as it is determined that superabrasive wear is occurring or has occurred, the applied force or pressure and/or RPM between the CMP pad dresser and the CMP pad may be varied accordingly in order to maintain more optimal asperity configurations in the surface of the CMP pad such as depth, width, density, etc.

In one aspect of the present invention, a determination of the extent of superabrasive particle wear may include an examination of a dressed CMP pad surface. The depth, width, density, etc., of the asperities cut into the CMP pad surface can give one skilled in the art some indication of the extent of the wear of the superabrasive particles. One advantage of this examination method is the ability to estimate superabrasive particle wear without the need of removing the dresser from the polishing apparatus. Such examination can occur manually through visual observation with or without a magnification apparatus, or by other means of ascertaining the CMP pad surface texture. Examination can also occur automatically through visual imaging or mechanical measuring processes.

In another aspect of the present invention, as discussed above, determining superabrasive particle wear can be performed by measuring a mechanical property of the pad, dresser, or combination thereof. The measured mechanical property can be selected from the group consisting of frictional force, acoustic emission, temperature, pad reflectivity, pad flexibility, pad elasticity, and combinations thereof. As such, in one aspect the measured mechanical property can be frictional force. In another aspect, the measured mechanical property can be acoustic emission. In another aspect, the measured mechanical property can be temperature. In another aspect, the measured mechanical property can be pad reflectivity. In another aspect, the measured mechanical property can be pad flexibility. In another aspect, the measured mechanical property can be pad elasticity.

Virtually any aspect of the pattern of asperities can be utilized to evaluate the extent of superabrasive particle wear and thus trigger a variation in pressure and/or RPM. By improving at least one characteristic of the pattern of asperities by varying the cutting pressure and/or RPM, slurry can be more effectively held on the surface of the CMP pad and more evenly distributed, polishing rate may be improved, and the service life of the dresser will be increased. In one aspect, the pressure and/or RPM may be increased when the CMP pad surface exhibits a decrease in average asperity density. Such a decrease in density may occur due to an increase in width, a decrease in length, etc. It may also be a result of ineffective cutting by the superabrasive particles. Dull superabrasive particles may only intermittently cut the CMP pad surface, thus decreasing the density of asperities thereon.

In another aspect, the pressure and/or RPM may be increased when the CMP pad surface exhibits a decrease in average asperity depth. As the superabrasive particles begin to dull they no longer have sharp tips and edges that allow deep asperities to be cut. By increasing the cutting pressure and/or RPM, the superabrasive particles will be pressed further into the CMP pad surface and more evenly distributed, thus cutting deeper asperities that can hold more slurry.

In yet another aspect, the pressure and/or RPM may be increased when the CMP pad surface exhibits a decrease in average asperity width. As has been described, as the superabrasive particles wear, their tips and edges become rounded and smooth. As the tips and edges wear off, these particles begin to cut wider asperities that reflect their now-worn surfaces. Though increasing pressure and/or RPM may not decrease the width of the asperities back to pre-dull levels, it may allow deeper asperities to be cut, thus allowing retention of larger amounts of slurry during polishing.

In a further aspect, the pressure and/or RPM may be increased when the CMP pad surface exhibits a decrease in average asperity length. As the tips and edges of the superabrasive particles wear, they have a tendency to locally deform the surface of the CMP pad rather than cut asperities in it. As such, worn superabrasive particles tend to intermittently cut and deflect the surface, thus creating asperities with a decreased average length. By increasing the downward pressure and/or RPM of the superabrasive particles, cutting can be prolonged, thus increasing the average length of the asperities in the pad surface.

Additionally, if the CMP pad surface asperities are deeper, wider, longer, or denser that what is required to hold the slurry, the pressure and/or RPM between the pad and the dresser may be decreased to slow down the wear of the superabrasive particles, and thus extend the service life of the dresser.

Another method of determining the extent of superabrasive particle wear may include an examination of at least a portion of the plurality of superabrasive particles disposed on the dresser. Though direct examination of the condition of the superabrasive particles may entail removing the dresser from the surface of the CMP pad, such an examination may provide a more accurate assessment of the surface of the dresser than merely observing the cutting pattern of the tool. Following such an assessment, the pressure and/or RPM applied by the dresser to the surface of the CMP pad can be varied relative to the amount of superabrasive particle wear observed.

Yet another method of determining the extent of superabrasive particle wear may include an estimation of superabrasive particle wear based on dresser use. Over time, one skilled in the art may be able to estimate superabrasive particle wear patterns based on wear patterns of previous CMP pad dressers. In many situations this estimation method may prove to be beneficial due to its cost effective nature. Varying the pressure and/or RPM between the CMP pad dresser and the surface of the pad due to estimated superabrasive particle wear patterns precludes the need for stopping the polishing process to examine the surface of the CMP pad or the condition of the superabrasive particles in the dresser.

Various methods of altering the pressure and/or RPM between the CMP pad dresser and the pad surface are contemplated, and all would be considered to be within the scope of the present invention. For example, in one aspect varying the pressure and/or RPM may include a manual adjustment. When it is determined that the superabrasive particles on the dresser have become worn, the pressure and/or RPM can be varied manually to take into account and thus counteract such a worn condition. Such a manual change may occur as a result of observing the asperities in the pad surface, examining the condition of the superabrasive particles on the dresser, or estimating the amount of wear based on dresser use.

It is also contemplated that the pressure and/or RPM between the CMP pad dresser and the pad surface may be varied automatically. Numerous automatic methods are possible, including automatic variations as a result of observations of superabrasive particle wear, estimations of superabrasive particle wear, anticipation of superabrasive particle wear, etc. This may include notification of the observed wear of the superabrasive particles followed by an automatic increase. Alternatively, the pressure and/or RPM may be increased as the dresser has been utilized to a point that an estimated level of superabrasive particle wear has been achieved. In one aspect, a computer control is utilized to automatically vary the pressure and/or RPM. Such a computer control may allow the increase of pressure and/or RPM over a large number of polished wafers. As such, in one aspect the pressure and/or RPM can be initially increased by very small increments when the superabrasive particles are sharp, and subsequently increased by larger amounts as they begin to dull. For example, the pressure and/or RPM can be increased by about 1% for the first 500 wafers polished, 5% for the next 500 wafers polished, 10% for the next 500 wafers polished, etc. In another aspect, the computer control can increase the amount of pressure and/or RPM for each successive wafer in order to more effectively extend the service life of the dresser.

Other pressure and/or RPM increasing methods may include situations where the pressure and/or RPM is increased without regard to actual or estimated wear. In one aspect, the pressure and/or RPM between the pad and the dresser may be gradually increased over time as the dresser is used. For example, in one aspect the pressure and/or RPM between the pad and the dresser may be increased following a dressing operation. In those cases where the dresser is intermittently dressing the pad while the pad is polishing a wafer, the pressure and/or RPM may be increased following one or more dressing operations during polishing. The pressure and/or RPM may also be increased following each dressing operation of the dresser. In another aspect, the pressure and/or RPM may be increased during a dressing operation. This would entail increasing the pressure and/or RPM between the pad and the dresser while the dresser is in contact with and is actively dressing the pad. In yet another aspect, the pressure and/or RPM between the pad and the dresser is increased following completion of polishing of a wafer. Pressure and/or RPM may be increased following the polishing of a set number of wafers, or may be increased following the polishing of each wafer.

Various non-limiting examples of gradually increasing pressure and/or RPM may include linear increases, non-linear increases, exponential or logarithmic increases, stepwise increases, etc. This method provides the benefit of not requiring an examination or estimation step to ascertain superabrasive particle wear. Additionally, pressure and/or RPM may be increased in anticipation of a worn condition. It may be the case that the service life of a CMP pad dresser may be further increased by varying pressure and/or RPM in anticipation of rather than as a result of superabrasive particle wear.

Various methods of varying pressure and/or RPM may also include the automatic detection of phenomenon that may be indicative of a given level of superabrasive particle wear, as discussed above. For example, as the superabrasive particles on the dresser begin to become dull and rounded, friction between the dresser and the pad may increase. In one aspect, such an increase in friction due to superabrasive particle wear may be detected, and the pressure and/or RPM between the pad and the dresser may be increased in order to compensate.

In another embodiment, a method for extending the service life of a chemical mechanical polishing pad dresser used to dress a chemical mechanical polishing pad, where the dresser has a substrate and a plurality of superabrasive particles disposed thereon, can comprise dressing the chemical mechanical polishing pad with the dresser; vibrating, in a direction substantially parallel to a working surface of the pad, a member selected from the pad, the dresser, a wafer being polished by the pad, or any combination thereof, to minimize a mechanical stress on the pad, dresser, wafer, or combination thereof; and varying the pressure and RPM between the pad and the dresser, including gradually increasing the pressure and/or the RPM between the pad and the dresser in a non-linear manner over time as the dresser is used, such that the dresser life is extended, wherein the pressure and the RPM is increased when the chemical mechanical polishing pad surface exhibits wear.

In addition to varying pressure and/or RPM, the inventors have found that certain vibrations imparted to abrasive particles of a CMP dresser during routine conditioning cycles can reduce the drag coefficient imparted on the superabrasive particles which may result in many benefits to the CMP pad and dresser itself. For example, a reduced drag coefficient may create CMP pad asperities having substantially uniform heights and CMP pad troughs or grooves having substantially uniform depths. Additionally, the inventors have discovered that CMP pads possessing such properties can have more predictable polishing rates and can promote higher quality polished wafers. Other benefits derived from reduced drag coefficients are CMP pads having an extended service life and reduced wear on the superabrasive particles.

Vibrating the CMP apparatus (including any portion of the CMP pad, CMP pad dresser, or wafer), also reduces stick-slip of the materials. That is to say that vibrating the pad, dresser, and/or wafer reduces the direct and potentially harmful contact that they have upon contacting each other. Often, materials have a tendency to stick on each other (due to the forces of friction) and then slip. In most applications of movement, this effect is not detrimental, damaging or even a hindrance, however, in dealing with materials with such a tight tolerance for thickness and surface variance, these stick-slip effects can be very damaging. Including a vibrational aspect to CMP allows for more efficient polishing and dressing. There will be less tearing and deformation in both processes due to the reduced stick-slip. The efficiency of the process is further improved by the vibrating in that the consumption of slurry, if used at all, can be reduced. The vibrating allows for the slurry particles to be used many more times before it is dislodged, again as a result of the reduced stick-slip.

The vibrational movements of the particles have been found to be effective at improving the wear on the particles as well as improving the rejuvenated properties of a CMP pad. Functionally, the vibrations can reduce the amount of pad material and frequency that the material comes into contact with the superabrasive particles. As the superabrasive particles vibrate at ultrasonic rates and cut into the CMP pad, a consistent portion of material can be displaced on both sides of the superabrasive particles thereby creating uniform heights in asperities to promote uniform polishing of wafers. Additionally, a minimized drag coefficient can reduce the wear on and extend the service life of the superabrasive particles by limiting the amount of contact with the CMP pad material during a grooming process.

Accordingly, a method that reduces drag coefficients on CMP pad particles can create CMP pad asperities having substantially uniform heights and troughs having uniform depths. The uniform heights and depths can be created by the specific vibrations imparted on the dresser particles. Specifically, the particles can vibrate in either a lateral, circular, elliptical, or any random motion that is substantially parallel to the working surface of the CMP pad. In one aspect of the present invention, the particles are vibrated laterally, i.e. side to side, such that the dragging is reduced since the amount of pad contacted is reduced. It has also been discovered that the amount of drag is significantly reduced when the particles vibrate substantially parallel to the working surface of the CMP pad, instead of vibrating perpendicularly or vertically to the working surface of the pad. As a result, many benefits to the CMP pad and dresser can be obtained, such as uniform and minimal asperity sizes.

Vibrators, or a source of vibration, may be located at various locations on the CMP apparatus. The vibrator may be attached to the CMP pad at any location that can produce oscillations in a direction substantially parallel to the working surface of the CMP pad. Examples include attachment or coupling to the side or periphery of the CMP pad, attachment to any portion of the underside of the CMP pad (i.e. the pad substrate that is the opposite side of the working surface, attachment to the side of the CMP pad, inclusion in any feature attached to the CMP pad (i.e. shafts, backings), etc. Likewise, attachments to the CMP pad dresser may be to the side of the substrate, periphery of the working surface, on the underside of the dresser, in a shaft or other encasement, etc. Attachment to the wafer is possible through the instrument attached to the wafer (such as the retainer ring), or to the wafer directly, via any method known in the art.

In the present invention, the CMP pad dresser or CMP pad can have at least one vibrator coupled to the dresser at a location that vibrates the dresser in a direction substantially parallel to a working surface of the CMP pad with which the CMP pad dresser is engaged. One vibrator can be coupled to the CMP pad dresser, although multiple vibrators may be needed to obtain the proper vibration of the superabrasive particles. With the use of a vibrator, the vibrator can impart vibrations on the superabrasive particles of the CMP pad dresser, which in turn can reduce the drag coefficient. The vibrator may be of any type capable of producing the herein outlined beneficial vibrations. Any electro/mechanical actuation system may be utilized to produce the desired vibrations. In accordance with one aspect of the present invention, the vibrator may be an ultrasonic transducer comprised of a piezoelectric material. Alternatively, the vibrator may be a solenoid with coils of conducting wire. These embodiments are in no wise limiting; other vibrator means may be employed. In another embodiment, multiple vibrators such as ultrasonic transducers, solenoids, or combinations thereof, can be coupled to the dresser at locations that vibrate the dresser and the particles in a direction that is substantially parallel to the working surface of the CMP pad. The vibration may be directionally focused or diffused. Additionally, the vibrations may be amplified by an amplifier or dampened with a damping plate such as an acrylic board. In some aspects, the vibration may be directionally controlled, including back and forth directions, circular, square, figure eight, rectangle, triangle, and other simple or complex directional vibration movements and patterns may be used.

More than one vibrator may be used. In one embodiment, the vibrators may be designed to produce a symmetrical vibration, thus achieving resonance. In another embodiment, the vibrations from multiple sources can be asymmetrical, thus causing variation across the pad and/or wafer. This can be favorable in the case where a portion of the pad is least consumed, thus the vibrations may be intensified in that area so that the pad profile will have the effect of being flat. Such a design can balance pad usage and is useful to achieve a more uniform thickness or flatter surface of the wafer.

The frequency of the present invention may range from about 1 KHz to about 1000 KHz. The power range may be from about 1 W to about 1000 W. As previously mentioned, the vibrations imparted on the superabrasive particles of the CMP pad dresser originate from a vibrator or a vibration means such as piezoelectric transducers. In use, the CMP pad dresser or CMP pad can vibrate in either a lateral, circular, elliptical, or random motion substantially parallel to the working surface of the CMP pad in addition to the afore mentioned directions. Alternatively, the vibration may be completely in a direction parallel to the working surface of the CMP pad. The piezoelectric transducers should be suitable to vibrate the particles at ultrasonic frequencies greater than 15 kHz. Typically, frequencies higher than those audible to the human ear, i.e. more than about 15,000 cycles per second, are considered ultrasonic. In one embodiment the vibrator can oscillate the particles at a frequency of about 20 kHz.

In a further embodiment, the ultrasonic vibrations may greatly improve the process by dispersing slurry particles on the CMP pad. Slurry particles, either those present as part of a slurry to aid in the CMP process, or particles that have been removed from the objects being polished, have a tendency to adversely affect the polishing process. These particles may build up on portions of the CMP pad and scratch the object being polished, e.g. the wafer. Ultrasonic vibrations can disperse the slurry particles and provide a mechanism for more efficient removal of glazed materials and debris.

In another embodiment of the present invention, the vibrator can be adjusted to control the vibrational movements of the superabrasive particles, as well as the drag coefficient of each particle to obtain an optimal polishing experience. Controlling or adjusting either vibration frequency, amplitude or both of the ultrasonic wavelengths can alter the polishing performance for a given CMP pad dresser. Specifically, higher frequencies can produce asperities having higher ridges and/or deeper troughs. Alternatively, increasing the amplitude of the ultrasonic vibrations can also affect the asperity sizes, which can produce asperities that allow for more slurry to penetrate in to the pad surface thereby increasing the overall polishing performance of the system. In reality, controlling the vibrational frequency and amplitude alters the drag coefficient on each grooming superabrasive particle which alters the size of each asperity. Such an embodiment can be conducive for obtaining optimal polishing performance for various applications. For example, increasing the frequency and reducing the amplitude may be needed for optimal polishing of oxide layers on a more brittle wafer. On the other hand, reducing the frequency and increasing the amplitude of the vibrations can be more effective at polishing metal layers (e.g. copper circuit) on a wafer. Further, controlling the vibrational properties may be necessary when other polyurethane-type materials are used form a CMP pad that reacts differently under the pad dressing process.

In one embodiment, the vibrating can be continuous or interrupted. Additionally, the vibrating can be performed as part of a plurality of steps, or a program wherein different vibrational parameters are selected at specific times during the polishing process. The vibrational parameters include, without limitation, frequency, amplitude, and source. In general, large amplitude can cause faster removal but with higher likelihood of damage, while high frequency at low amplitude can polish slower but with better finish. Therefore, it logically follows that a polishing program that starts at a large amplitude and then changes to a high frequency low amplitude vibration can be very beneficial in producing a polished material in faster time, and with better finish than polishing with at a single set of vibrational parameters. The program can change continuously, e.g. changing from a large amplitude to a slow amplitude over time, or there may be different and distinct stages, e.g. changing from a large amplitude immediately to a slow amplitude, either with or without a time pause between changing.

For example, with the case of removal of copper, the CMP process can be controlled for fast removal initially by high amplitude low frequency while the copper surface is rough and then it can be ramped down to high frequency low amplitude when the end point is approaching such as when the barrier layer of tantalum nitride is exposed beneath the copper layer. Furthermore, the vibrational parameters can be modified in accordance to tune to specific conditions, such as addition of slurry, slurry viscosity, new wafer, different wafer-types, new or different pad conditioners or dressers, and other variables that reflect changing pad conditions. In another embodiment, the vibrations may cause the temperature of at least a portion of the CMP pad to increase by at least about 5° C. In another embodiment, the temperature may increase by at least about 20° C. Additionally, when the present methods using varying pressure, RPM, and vibration can provide a synergistic effect in extending the service life of a chemical mechanical polishing pad dresser.

It is to be understood that the above-described compositions and methods are only illustrative of preferred embodiments of the present invention. Numerous modifications and alternative arrangements may be devised by those skilled in the art without departing from the spirit and scope of the present invention and the appended claims are intended to cover such modifications and arrangements.

What is claimed is:

1. A method for extending the service life of a chemical mechanical polishing pad dresser used to dress a chemical mechanical polishing pad, the dresser having a substrate and a plurality of superabrasive particles disposed thereon, comprising:

dressing the chemical mechanical polishing pad with the dresser;

vibrating, in a direction substantially parallel to a working surface of the pad, a member selected from the pad, the dresser, a wafer being polished by the pad, or any combination thereof, to minimize a mechanical stress on the pad, dresser, wafer, or combination thereof;

determining superabrasive particle wear by measuring a mechanical property of the pad, dresser, or combination thereof; and responding to the mechanical property measurement by varying pressure and RPM between the pad and the dresser in relation to the superabrasive particle wear in order to extend dresser life.

2. The method of claim 1, wherein the measured mechanical property is selected from the group consisting of frictional force, acoustic emission, temperature, pad reflectivity, pad flexibility, pad elasticity, and combinations thereof.

3. The method of claim 1, wherein varying the pressure and RPM includes gradually increasing the pressure and RPM between the pad and the dresser.

4. The method of claim 3, wherein the gradual increase for the pressure and/or RPM over time is a nonlinear exponential increase.

5. The method of claim 1, wherein varying the pressure and RPM includes automatically increasing the pressure in response to increased superabrasive particle wear.

6. The method of claim 1, wherein the dresser vibrates in a lateral, circular, elliptical, or random motion substantially parallel to the working surface of the pad.

7. The method of claim 1, wherein the vibrating is only in a direction parallel to a working surface of the pad.

8. The method of claim 1, wherein the vibrating is at an ultrasonic frequency greater than 15 kHz.

9. The method of claim 1, wherein the vibrating is continuous.

10. The method of claim 1, wherein the vibrating is diffused.

11. The method of claim 1, wherein pressure and RPM is increased when the chemical mechanical polishing pad surface exhibits a decrease in average asperity density, average asperity depth, average asperity width, average asperity length, or combination thereof.

12. A method for extending the service life of a chemical mechanical polishing pad dresser used to dress a chemical mechanical polishing pad, the dresser having a substrate and a plurality of superabrasive particles disposed thereon, comprising:

dressing the chemical mechanical polishing pad with the dresser;

vibrating, in a direction substantially parallel to a working surface of the pad, a member selected from the pad, the dresser, a wafer being polished by the pad, or any combination thereof, to minimize a mechanical stress on the pad, dresser, wafer, or combination thereof; and varying the pressure and RPM between the pad and the dresser, including gradually increasing the pressure and/or the RPM between the pad and the dresser in a nonlinear manner over time as the dresser is used, such that the dresser life is extended, wherein the pressure and the RPM is increased when the chemical mechanical polishing pad surface exhibits wear.

13. The method of claim 12, further comprising determining superabrasive particle wear.

14. The method of claim 13, wherein determining superabrasive particle wear includes measuring a mechanical property of the pad, dresser, or combination thereof.

15. The method of claim 14, wherein the measured mechanical property is selected from the group consisting of frictional force, acoustic emission, temperature, pad reflectivity, pad flexibility, pad elasticity, and combinations thereof.

16. The method of claim 15, wherein determining superabrasive particle wear further includes examination of a dressed chemical mechanical polishing pad surface.

17. The method of claim 16, wherein pressure and RPM is increased when the chemical mechanical polishing pad surface exhibits a decrease in average asperity density, average asperity depth, average asperity width, average asperity length, or combination thereof.

18. The method of claim 13, wherein determining superabrasive particle wear further includes an estimation of superabrasive particle wear based on dresser use.

19. The method of claim 12, wherein the vibrating is only in a direction parallel to a working surface of the pad at an ultrasonic frequency greater than 15 kHz.

* * * * *